United States Patent [19]

Bartl et al.

[11] Patent Number: 5,044,905

[45] Date of Patent: Sep. 3, 1991

[54] DEVICE FOR MINIMIZING FLUTTER OF A FILLER PIECE IN AN INTERNAL GEAR PUMP

[75] Inventors: Max Bartl, Munich; Richard Strehler, Chieming, both of Fed. Rep. of Germany

[73] Assignee: Carl Hurth Maschinen- und Zahnradfabrik GmbH & Co., Munich, Fed. Rep. of Germany

[21] Appl. No.: 521,896

[22] Filed: May 10, 1990

[30] Foreign Application Priority Data

May 18, 1989 [DE] Fed. Rep. of Germany ..... 3916155
Feb. 23, 1990 [DE] Fed. Rep. of Germany ... 9002160[U]

[51] Int. Cl.[5] ..... F04C 2/10

[52] U.S. Cl. ..... 418/126; 418/169; 418/170

[58] Field of Search ..... 418/126, 169, 170

[56] References Cited

U.S. PATENT DOCUMENTS 3,486,459 12/1969 Eltze ..... 418/170
3,890,066 6/1975 Eckerle ..... 418/126

FOREIGN PATENT DOCUMENTS 2641278 3/1978 Fed. Rep. of Germany ..... 418/126

*Primary Examiner*—Leonard E. Smith
*Assistant Examiner*—David L. Cavanaugh
*Attorney, Agent, or Firm*—Flynn, Thiel, Boutell & Tanis

[57] ABSTRACT

A gear pump which includes a housing having an internally toothed gear and a pinion meshing with the internally toothed gear disposed therein. The housing has a sickle-shaped space between the two gears and has therein a filler piece. In order to avoid a fluttering of the filler piece and the noises connected therewith, structure is provided for urging the filler piece, due to pressurized oil being guided from the pressure chamber and one side of the filler piece into a bore extending through the filler piece to the opposite side of the filler piece, against the pump housing. The filler piece can also be locked in the direction of rotation by a pressure piece also loaded by the pressurized oil.

8 Claims, 1 Drawing Sheet

DEVICE FOR MINIMIZING FLUTTER OF A FILLER PIECE IN AN INTERNAL GEAR PUMP

FIELD OF THE INVENTION

The invention relates to an internal gear pump.

BACKGROUND OF THE INVENTION

In conventional pumps of the mentioned type, the sickle-shaped filler piece has the tendency to a device for minimizing flutter of a filler piece in "flutter" at certain pressures and/or speed ranges and thus has the tendency to develop noise often identified as being unbearable. The reason for this lies in the radial clearance between the filler piece and the two tooth systems, which clearance permits a back and forth pivoting of the filler piece depending on the pressures just then existing on the internally toothed gear side or on the pinion side. It is known from DE 25 33 646 C2 to design the filler piece in two parts and to press the two parts against the teeth addendum of the internally toothed gear or of the pinion. In the case of pumps running at very high speed (up to 6000 rotations per minute) this solution cannot be applied because of the occurring wear.

SUMMARY OF THE INVENTION

Starting out from these disadvantages of conventional pumps, the basic purpose of the invention is to provide a gear pump of the mentioned type such that the sickle-shaped filler piece is prevented from "fluttering" and the noise development connected therewith is prevented as much as possible.

This purpose is attained with a gear pump having a filler piece with a groove in one side thereof. With this it is achieved that the filler piece is loaded on the grooved side with the pressurized oil such that the filler piece is pressed against the housing. In a further advantageous development, the oil pressure is also utilized to fix the filler piece in the direction of rotation of the pump.

The filler piece is in the inventively designed gear pump—in relationship to the internally toothed gear and the pinion—force-lockingly fixed in axial direction as soon as an—even if only low—oil pressure has built up in the pump. The filler piece can thereby be held in radial direction and/or in direction of rotation of the pump by conventional means, for example by a spring element received in the housing and penetrating through the filler piece. The oil pressure is, however, also advantageously utilized here. The filler piece can, as soon as the pump operates, adjust freely in each direction and is then fixed partly by the oil pressure acting onto the base of a groove and partly by a pressure piece, supported in the housing under the oil pressure, between the wall of a bore and a sloped surface. A "fluttering" of the filler piece is thereby practically impossible and rattling noises can thus not be produced.

A filler piece (sickle) having a groove in one flat side thereof and connected in fluid circuit to a pressure side of the pump is known from U.S. Pat. No. 2 544 144. This groove has a comparatively small cross section and ends in a further groove having a larger cross section extending transversely thereto. The groove with the larger cross section is connected to the tooth gaps of the internally toothed gear and the pinion, namely, between the suction side and the pressure side, thus still in the pressureless area. The pressure of the oil flowing through the groove with the small cross section is continuously reduced and is not sufficient to fix the filler piece in axial direction as this is the case in the invention.

BRIEF DESCRIPTION OF THE DRAWINGS

Two exemplary embodiments of the invention are illustrated in the drawings, in which.

DETAILED DESCRIPTION

Figure 1:
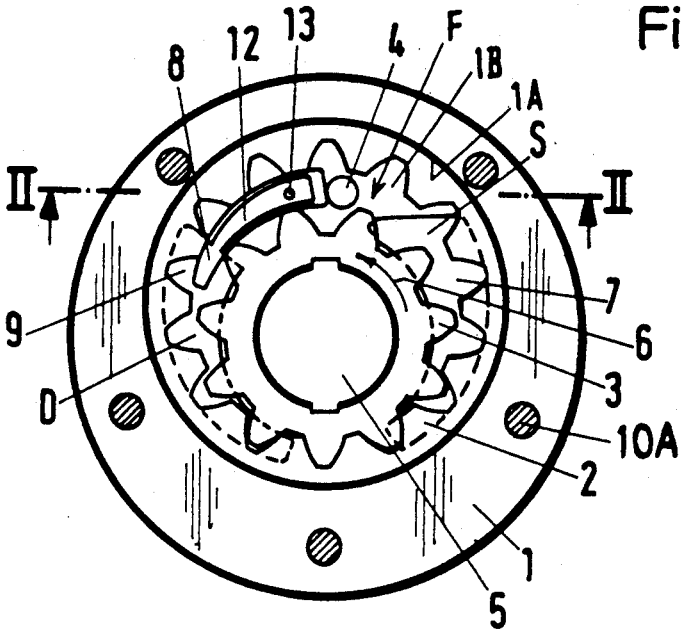
FIG. 1 is a top view of a gear pump of the invention with the lid having been removed.

An internally toothed ring gear 2 is rotatably supported chamber 1A of a housing 1 of a gear pump (FIG. 1), which chamber has a bottom wall 1B. An externally toothed pinion 3 is arranged—also rotatably supported—within the internally toothed gear 2 and is radially offset with respect thereto. The external teeth on the pinion 3 mesh with the internal teeth on the gear 2. On the side opposite the meshing engagement there remains a substantially sickle-shaped or crescent shaped free space-divided into two parts by a pin 4 received an opening 1C therefor in the bottom wall 1B of the housing 1. The pin 4 is spaced only a very short radial distance from the teeth addendum of the internally toothed gear 2 and pinion 3. One part of the free space defines an oil chamber S on the suction side and the other part defines an oil chamber D on the pressure side. The two oil chambers S and D, the internally toothed gear 2 and the pinion 3 are covered by a lid 10 (FIG. 2) secured by screws 10A to the housing. When the pinion 3, which incidently is provided with a central bore 5 and keyways and receives a shaft (not illustrated) therein, is driven in direction of the arrow 6, oil is sucked in at a first opening 7 in the housing 1. The still turbulent oil is moved in direction of the arrow 6 and is split by the pin 4, namely, the oil moves only into the tooth gaps of the internally toothed gear 2 and the pinion 3 as it passes the pin 4. A filler piece 8, widely known as a sickle, which will be discussed later on, prevents the oil from exiting out of the tooth gaps, so that the oil is flow controlled or squeezed in the part of the oil chamber D following the filler piece 8 and exits under pressure from the housing 1 through a second opening 9 and is fed to a consumer (not illustrated).

The sickle 8 has on its flat side 11 facing the lid 10 a groove 12 starting adjacent its narrow tip end or end remote from the pin 4, and extends from the oil chamber D on the pressure side to the vicinity of its wide end adjacent the pin 4. A bore 13 extends through the sickle 8 from the groove 12 in the area of the large end to a cylindrical enlargement 14 opening outwardly of the sickle on an opposite flat side 15 to face the bottom wall 1B. A ball 16 of conforming size is received in the opening 14. The ball 16 projects beyond the flat side 15 and rests thereby on an annular conical surface 17 on the bottom wall 1B leading to a depression 18 offset toward the pin 4 or rather the wide end of the sickle 8 relative to the bore 13.

When the pump is operating, the sickle 8 will yield or move in direction of the arrow 6, thus in direction of its acute angled end, because of its also only very short radial spacing from the teeth addendum of the internally toothed gear 2 and externally toothed pinion 3 and the thus existing inner friction. However, as soon as a pressure builds up in the oil chamber D, the pressure acts through the groove 12 and the bore 13 also on the ball 16 supported on the annular conical surface 17 and on the wall of the enlarged opening 14. The sickle 8 is thus urged in a direction opposite the arrow 6 until it engages the pin 4, which pin 4 thus also serves as a support element. The pressure existing in the groove 12 causes the sickle 8 to be pressed against the bottom wall 1B, thus practically eliminating the "fluttering" of the sickle 8 and the noises related thereto.

Figure 3:
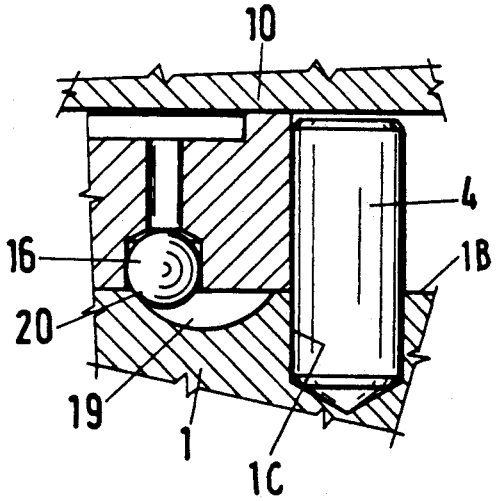
FIG. 3 illustrates a modification of the first embodiment according to FIG. 2.

In place of the depression 18 with the annular conical surface 17, it is also possible to provide a slot-like recess 19 in the form of a milled slot having a sloped surface 20 (FIG. 3).

Figure 4:
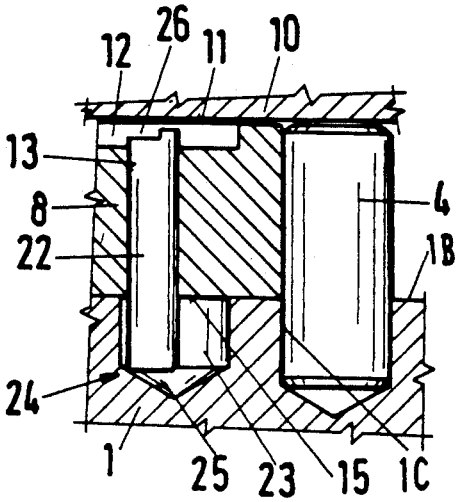
FIG. 4 is a fragmentary cross-sectional view taken along the line II—II of FIG. 1 in an enlarged scale of a second embodiment.

The exemplary embodiment illustrated in FIG. 4 has, in place of a ball, a retaining pin 22 serving as a pressure piece received in the bore 13. The retaining pin 22 projects beyond the flat side 15 and rests with its advantageously rounded or sloped contoured edge 24 on an annular conical surface 25 of a depression 23 provided in the bottom wall 1B to cause the sickle 8 to be urged toward the pin 4 or rather toward the wide end of the sickle 8 relative to the bore 13.

Figure 2:
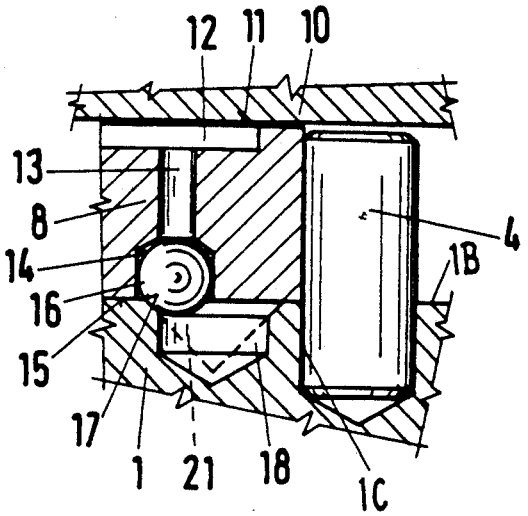
FIG. 2 is a fragmentary cross-sectional view of a first embodiment taken along the line II—II of FIG. 1 in an enlarged scale.

In place of the cylindrical depression 23 with the annular conical surface 25, it is also possible to provide, instead, the depression 18 with the annular conical surface 17 according to FIG. 2 or the slot-like recess 19 in the form of a milled slot with the sloped surface 20 according to Claim 3.

The length of the retaining pin 22 is dimensioned such that it projects, even when resting on the lid 10, into the depression 23 or like recess in the bottom wall 1B having the annular conical surface 25 or like sloped surface. To prevent the flat end surface of the retaining pin 22 facing the lid 10 from adhering to the lid 10, same can be provided with a shoulder or rib in a suitable manner, for example, a shoulder 26, or it can be annularly ribbed or it is designed spherically or the like. The oil pressure existing in the groove 13 can then act onto the shouldered surface to release the retaining pin 22 from the lid 10.

The invention permits further modifications which also fall within the scope of protection. Thus, in place of the depression 18 with the annular conical surface 17, a conical depression 21 can also be designed, such as is shown in broken lines in FIG. 2. Housing 1 and lid 10 can be exchanged in a further modification which does not influence the effect of the measures of the invention.

The embodiments of the invention in which an exclusive property or privilege is claimed are defined as follows:

1. In a gear pump comprising a housing having a chamber with a bottom wall closed off with a lid, an internally toothed gear rotatably supported in said chamber, an externally toothed pinion in said chamber, the teeth of which is in meshing engagement with teeth on said internally toothed gear, means defining a sickle-shaped free space between said internally toothed gear and said pinion, one end of said free space communicating with a first opening and a suction side of said gear pump, an end of said free space communicating with a second opening and a pressure side of said gear pump, and a sickle-shaped filler piece located between said suction side and said pressure side of said gear pump in said free space, which filler piece is at a wide end thereof adjacent said suction side opposing a support element extending through said free space, said filler piece being normally spaced from said bottom wall, said lid and the teeth on said gear and said pinion so that said filler piece will normally flutter in said free space as fluid is moved through said gear pump, the improvement wherein said filler piece has a flat side facing said lid, a groove in said flat side extending from a narrow end of said filler piece to a location adjacent its opposite wide end, which groove is connected in fluid circuit to the pressure side of said gear pump to allow the pressurized fluid to enter the groove and urge said filler piece toward and into engagement with said bottom wall of said chamber to retard the flutter of said filler piece in said free space.

2. The gear pump according to claim 1, wherein said filler piece includes a bore extending through said filler piece from the groove in said filler piece toward an opposite flat side of said filler piece facing said bottom wall, which bore movably receives a pressure piece of a corresponding diameter such that said pressure piece projects from said opposite flat side on said filler piece and rests on a sloped surface of a recess provided in said bottom wall, which sloped surface is directed toward said support element so that as said pressurized fluid enters said groove, said pressure piece will be movably urged along said sloped surface to additionally cause said filler piece to be moved into engagement with said support element to additionally retard the flutter of said filler piece in said free space.

3. The gear pump according to claim 2, wherein said bore includes an enlarged cylindrical opening, which opening opens outwardly of said filler piece toward said bottom wall of said chamber, and wherein said pressure piece is a ball received in said cylindrically enlarged opening.

4. The gear pump according to claim 2, wherein said pressure piece is an elongated retaining pin.

5. The gear pump according to claim 4, wherein said retaining pin has means thereon for preventing adherence to said lid.

6. The gear pump according to claim 2, wherein said sloped surface is formed by a slot-like recess.

7. The gear pump according to claim 2, wherein said recess is a depression offset relative to said bore toward said support element and has an annular conical surface forming said sloped surface for abutment with said pressure piece.

8. The gear pump according to claim 5, wherein said adherence preventing means is a shoulder on an end of said retaining pin facing said lid.

* * * * *